US009441402B2

(12) United States Patent
Larsen et al.

(10) Patent No.: US 9,441,402 B2
(45) Date of Patent: Sep. 13, 2016

(54) POWER ACTUATOR

(75) Inventors: Christopher L. Larsen, Toronto (CA); Keith A. Morgan, Mississauga (CA); Drew Robert Freeman, London (CA)

(73) Assignee: Magna Closures Inc., Newmarket (CA)

( * ) Notice: Subject to any disclaimer, the term of this patent is extended or adjusted under 35 U.S.C. 154(b) by 2047 days.

(21) Appl. No.: 11/721,387

(22) PCT Filed: Dec. 9, 2005

(86) PCT No.: PCT/CA2005/001872

§ 371 (c)(1),
(2), (4) Date: May 22, 2009

(87) PCT Pub. No.: WO2006/060915

PCT Pub. Date: Jun. 15, 2006

(65) Prior Publication Data

US 2009/0288506 A1 Nov. 26, 2009

Related U.S. Application Data

(60) Provisional application No. 60/634,873, filed on Dec. 10, 2004.

(51) Int. Cl.

| | |
|---|---|
| ***E05C 3/06*** | (2006.01) |
| ***E05B 81/24*** | (2014.01) |
| ***E05B 15/00*** | (2006.01) |
| ***E05B 81/50*** | (2014.01) |

(52) U.S. Cl.

CPC ..... *E05B 81/25* (2013.01); *E05B 15/0086* (2013.01); *E05B 81/50* (2013.01); *Y10T 74/18792* (2015.01)

(58) Field of Classification Search

CPC ..... E05B 15/0086; E05B 81/25; E05B 81/50

USPC ..... 292/201, 219, DIG. 62

See application file for complete search history.

(56) References Cited

U.S. PATENT DOCUMENTS 4,126,341 A * 11/1978 Bradstock ..... 292/201
4,518,180 A * 5/1985 Kleefeldt et al. ..... 292/201

(Continued)

FOREIGN PATENT DOCUMENTS

| | | | |
|---|---|---|---|
| DE | 10358640 | A1 | 7/2004 |
| DE | 10319743 | A1 | 9/2004 |
| WO | WO 02/063122 | A1 | 8/2002 |

OTHER PUBLICATIONS

EP 05815955, Supplementary European Search Report, Jan. 2, 2013.

*Primary Examiner* — Kristina Fulton
*Assistant Examiner* — Thomas Neubauer
(74) *Attorney, Agent, or Firm* — Dickinson Wright PLLC

(57) ABSTRACT

A power actuator is provided for a door latch. A transfer lever within the housing is selectively coupled to a motor-driven worm gear via a lost motion connector. Engaging the motor moves the transfer lever between a locked and an unlocked position, actuating an output lever mounted to a spline on the transfer lever. The worm gear returns to a neutral position when the motor is disengaged, leaving the transfer lever in either the locked or unlocked positions. Manually moving the output lever causes the transfer lever to move between its locked and unlocked positions without back-driving the worm gear. A toggle mechanism prevents the transfer lever from accidentally moving or only moving partially between the locked and unlocked positions.

27 Claims, 6 Drawing Sheets

(56) References Cited

U.S. PATENT DOCUMENTS

| | | | | |
|---|---|---|---|---|
| 4,779,912 | A * | 10/1988 | Ikeda et al. | 292/336.3 |
| 5,035,453 | A | 7/1991 | Fukumoto et al. | |
| 5,564,308 | A * | 10/1996 | Hoshikawa et al. | 74/89.14 |
| 5,855,130 | A * | 1/1999 | Rorabacher et al. | 70/277 |
| 5,951,070 | A * | 9/1999 | Spurr | 292/201 |
| 6,019,402 | A * | 2/2000 | Arabia et al. | 292/216 |
| 7,128,191 | B2 * | 10/2006 | Fisher | 188/265 |
| 2001/0038211 | A1 * | 11/2001 | Hayakawa et al. | 292/201 |
| 2008/0203737 | A1 * | 8/2008 | Tomaszewski et al. | 292/216 |

* cited by examiner

POWER ACTUATOR

CROSS-REFERENCE TO RELATED APPLICATIONS

This application is National Stage of International Application No. PCT/CA2005/01872, filed Dec. 9, 2005, which claims priority to and the benefit of U.S. Provisional Application No. 60/634,873 filed Dec. 10, 2004. The entire disclosure of each of the above applications is incorporated herein by reference.

FIELD OF THE INVENTION

The present invention relates to locking systems for motor vehicles. More specifically, the present invention relates to power actuator operable to lock or unlock a latch on a sliding side door.

BACKGROUND OF THE INVENTION

Motor vehicles with sliding doors (typically vans), typically use power actuators to electrically lock and unlock the sliding door. The power actuator is typically engaged by interior door lock switches or a remote key fob, and locks or unlocks a side door latch. Normally, the power actuator is connected to a lock lever on the side door latch via a door lock rod. Since the door latch can be locked or unlocked manually as well as electronically, the power actuator must also be able to move between a locked and an unlocked state un-powered, and without undesirable back drive from the power actuator's motor. Preferably, the power actuator is modular so that it can be easily installed and/or replaced. Additionally, the power actuator should be compact, reliable and inexpensive to manufacture.

It is therefore desired to provide a power actuator that locks and unlocks a side door latch, and further, will move between a locked and an unlocked state when the door latch is manually locked or unlocked without back-driving the power actuator's motor. It is further desired to provide a modular power actuator that is compact, reliable and inexpensive to manufacture.

SUMMARY OF THE INVENTION

According to a first aspect of the invention, there is provided a power actuator for a door latch. The power actuator includes a housing; a reversible motor, mounted to the housing; a worm, driven by the motor; and a worm gear, rotatably mounted to the housing and driven by the worm. The worm gear is rotatable between a first and a second angular position upon actuation of the motor. A spring, mounted to the housing, urges the worm gear to a neutral position intermediate the first and second angular positions when the motor is disengaged. The power actuator further includes a transfer lever, pivotally mounted to the housing and movable between a first and second positions. The transfer lever is kinematically coupled to the worm gear via a lost motion connection, thereby enabling the transfer lever to be moved between the first and second position without driving the worm gear when the worm gear is in the neutral position. An output lever is mounted to a spline on the transfer lever. A toggle mechanism prevents the transfer lever from accidentally moving, or only moving partially between the locked and unlocked positions.

DETAILED DESCRIPTION OF THE INVENTION

Figure 1:
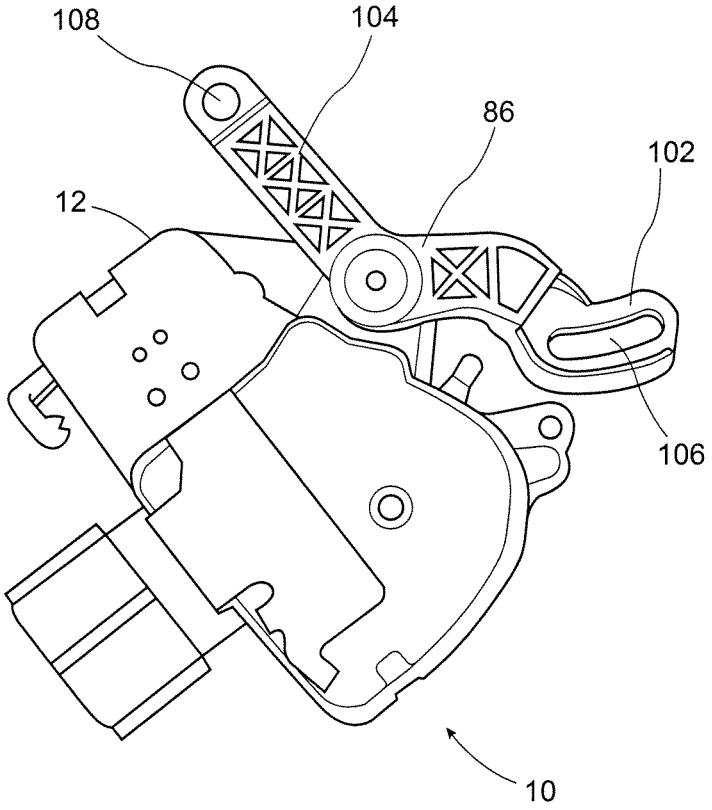
FIG. 1 is a plan view of a power actuator in accordance with a first aspect of the invention.
Figure 2:
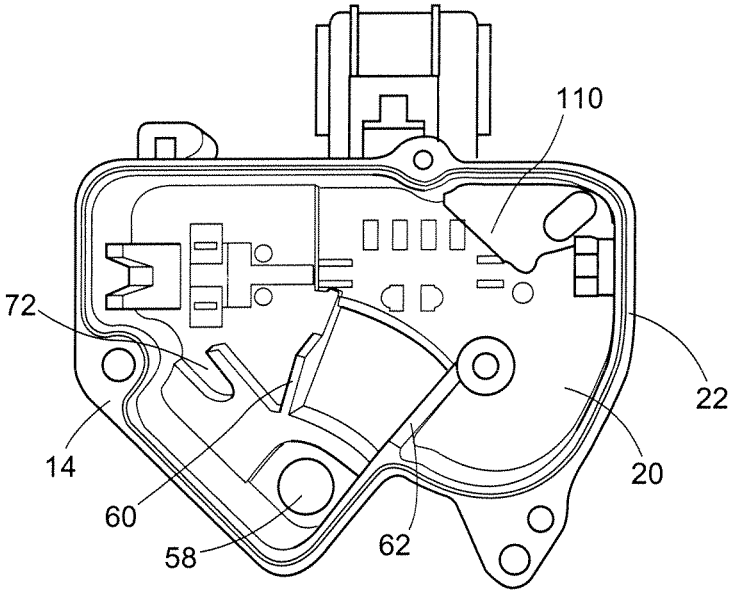
FIG. 2 is a plan view of an upper housing mounted of the power actuator shown in FIG. 1.
Figure 3:
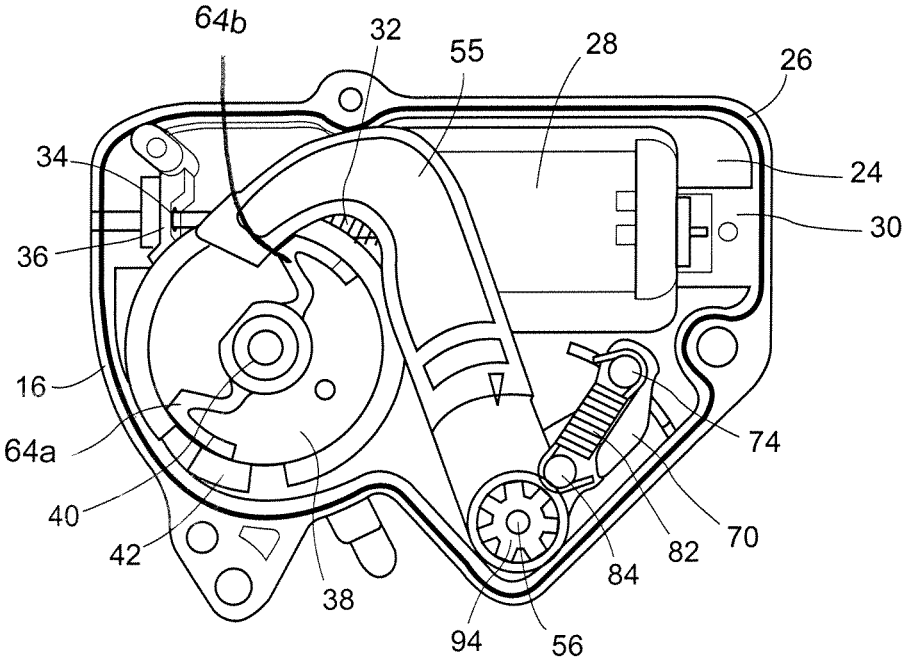
FIG. 3 is an inner plan view of the power actuator shown in FIG. 1.

Referring now to FIGS. 1-3, a power actuator according to the preferred embodiment is shown at 10. Power actuator 10 includes a clam-shell housing 12 formed from a complementary upper housing 14 and a lower housing 16. Preferably, both upper housing 14 and lower housing 16 are formed from a rigid thermoplastic material. An integrally-formed mounting structure (not shown) is provided on the exterior surface of lower housing 16 to mount power actuator 10 to a vehicle or vehicle module (not shown). Upper housing 14 includes a substrate 20, and peripheral walls 22 extending out from substrate 20 towards lower housing 16. Lower housing 16 includes a substrate 24 and peripheral walls 26. A detent on the top of peripheral walls 22 fits within a groove provided in the top of peripheral walls 26 to provide a weather-tight seal between the two housings.

A motor 28 is mounted within a motor housing 30 formed in substrate 24 on lower housing 16. Motor 28 is a bi-directional DC motor and is operable to drive a worm 32. The shaft of worm 32 is journalled within a centering hole 34 on a support wall 36 integrally formed from substrate 24.

Figure 4:
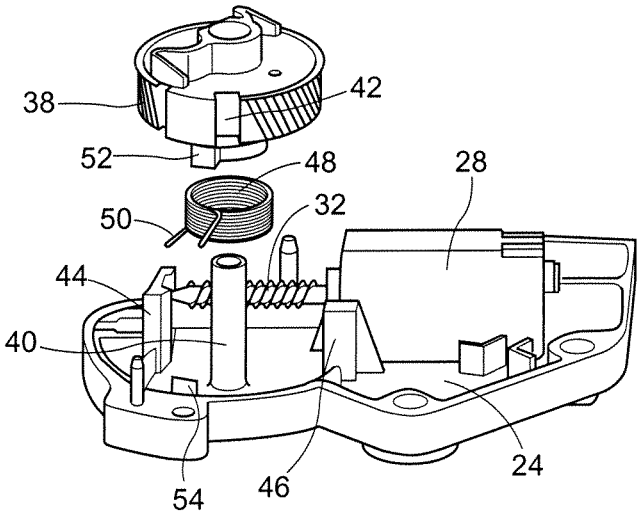
FIG. 4 is a partially exploded view of a drive train mounted in the power actuator of FIG. 1.

As can be more clearly seen in FIG. 4, worm 32 drives a worm gear 38 that is rotably mounted to a post 40 integrally formed from substrate 24. The angular travel of worm gear 38 is delimited by a stop tab 42 abutting a first shoulder 44, or a second shoulder 46. Thus, worm gear 38 is rotatable between a first or "locking" position, where stop tab 42 abuts the first shoulder 44, and a second or "unlocking" position, where stop tab 42 abuts the second shoulder 46. A centering spring 48 with a pair of toggle arms 50 is located around post 40 between worm gear 38 and substrate 24. As worm gear 38 rotates to either of the locking or unlocking positions, in response to actuation of motor 28, a depending tab 52 engages and pushes the leading toggle arm 50. A retaining tab 54 extending out from substrate 24 impedes the rotational motion of the trailing toggle arm 50, causing the centering spring 48 to twist and thereby load the spring. When motor 28 disengages, the tension on centering spring 48 is released, so that centering spring 48 reverses the direction of worn gear 38, backdriving motor 28. Worm gear 38 returns to a "neutral" position midway between the locking and the unlocking positions, where depending tab 52 and retaining tab 54 are aligned.

Figure 5A:
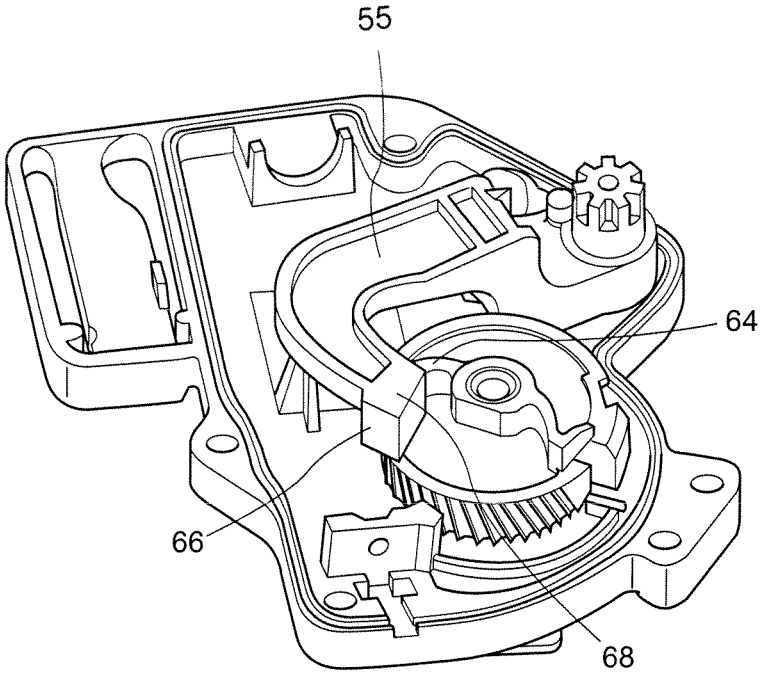
FIGS. 5*a* and 5*b* are fragmentary views of the power actuator shown in FIGS. 2-3, showing the motion of a transfer lever.
Figure 5B:
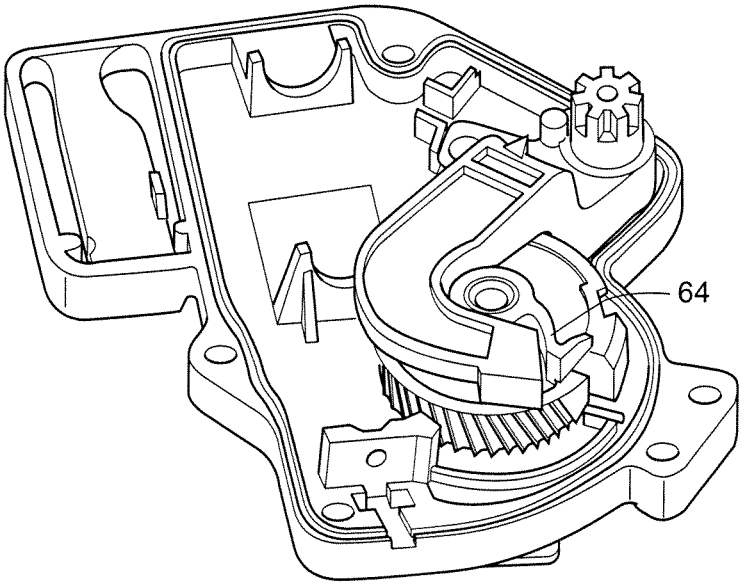
Figure 6:
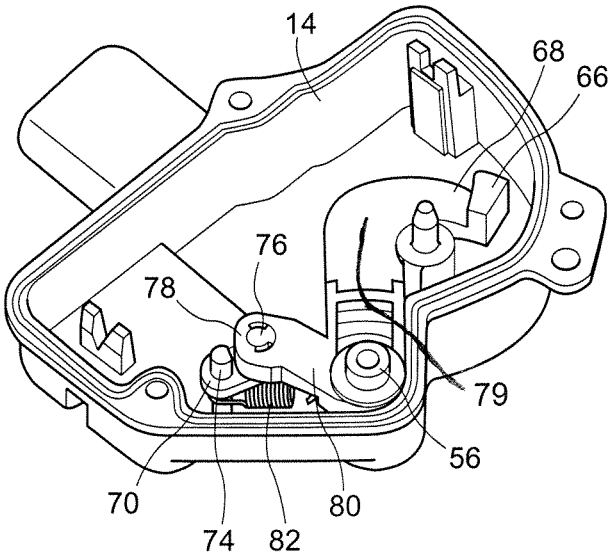
FIG. 6 is a fragmentary view of the power actuator shown in FIGS. 2-3, showing a locking lever.

A transfer lever 55 is pivotally mounted to power actuator 10. An axial post 56 locates transfer lever 55 in a hole 58 in upper housing 14 (FIG. 2) and lower housing 16 (not shown). As best shown in FIG. 6, the transfer lever 55 of the exemplary embodiment includes a first arm 79, also referred to as an engagement arm, extending radially from the axial post 56 for engaging the worm gear 38. The transfer lever 55 also includes a second arm 80, referred to as a locking arm, extending radially from the axial post 56 away from the first arm 79 and the worm gear 38. The angular motion of transfer lever 55 is delimited by a wall 60 and a wall 62, both integrally formed in upper housing 14. When transfer lever 55 abuts wall 60, it is in its "locked" position, and when transfer lever 55 abuts wall 62, it is in its "unlocked" position. Rotating worm gear 38 to the locking position actuates transfer lever 55 to its locked position, and conversely, rotating worm gear 38 to the unlocking position actuates transfer lever 55 to the unlocked position. In the illustrated embodiment, worm gear 38 includes a pair of curved transfer lobes 64*a* and 64*b* extending outward from the surface of the gear towards upper housing 14. While at rest, a depending tab 66 on the end of transfer lever 55 abuts one of the transfer lobes 64. As worm gear 38 rotates clockwise or counterclockwise towards either the locking or unlocking positions, the abutting transfer lobe 64 engages depending tab 66 to actuate transfer lever 55. When transfer lever 55 is in its locked position, depending tab 66 abuts transfer lobe 64*a* (FIG. 5*a*), and when transfer lever 55 is in its unlocked position, depending tab 66 abuts transfer lobe 64*b* (FIG. 5*b*). The arc of travel of transfer lobes 64 is substantially similar to the arc of travel of transfer lever 55. In addition, depending tab 66 includes a pair of symmetrically curved engagement surfaces 68, so that an even transfer of torque from worm gear 38 to transfer lever 55 is maintained for both the clockwise and counterclockwise rotation of worm gear 38. As is described above, once motor 28 disengages, the recoiling of centering spring 48 returns worm gear 38 to its neutral position. Thus, depending tab 66 now abuts the other transfer lobe 64, so it can quickly be actuated to the other position.

A locking lever 70 acts as a toggle mechanism and reduces the possibility of transfer lever 55 pivoting accidentally. or pivoting only partially between the locked and unlocked position. Referring now to FIG. 6, locking lever 70 is slidably retained within a guide slot 72 (FIG. 2) in substrate 20 via a guide post 74. Locking lever 70 is further pivotable between a first or "locked" and a second or "unlocked" position. As will be described in greater detail below, locking lever 70 is in its locked position when transfer lever 55 is in its locked position, and conversely, locking lever 70 is in its unlocked position when transfer lever 55 is in its unlocked position. A key post 76 extending from locking lever 70, and offset from guide post 74 is located in a keyhole 78 on a locking arm 80 of transfer lever 55, so that rotating transfer lever 55 rotates locking lever 70 in the opposite direction. A toggle spring 82 is hooked around guide post 74 on locking lever 70 and a depending post 84 on locking arm 80 near axial post 56. As transfer lever 55 begins to pivots from either the locked or unlocked position to the other position, the counter-rotation of keypost 76 within keyhole 78 on locking arm 80 displaces locking lever 70 away from transfer lever 55 within guide slot 72. The distance between guide post 74 and depending post 84 increases, thereby stretching locking toggle spring 82. Thus, toggle spring 82 provides a resisting force against the rotation of transfer lever 55. When both transfer lever 55 and locking lever 70 are midway between positions, toggle spring 82 is under maximal tension. When the two levers move past the midway point, the distance between guide post 74 and depending post 84 diminishes. Now, toggle spring 82 contracts, providing an assisting force urging the two levers into their destined position. As will be apparent to those of skill in the art, the strength of toggle spring 82 can be changed in order to increase or decrease the effort required to pivot transfer lever 55.

Figure 7:
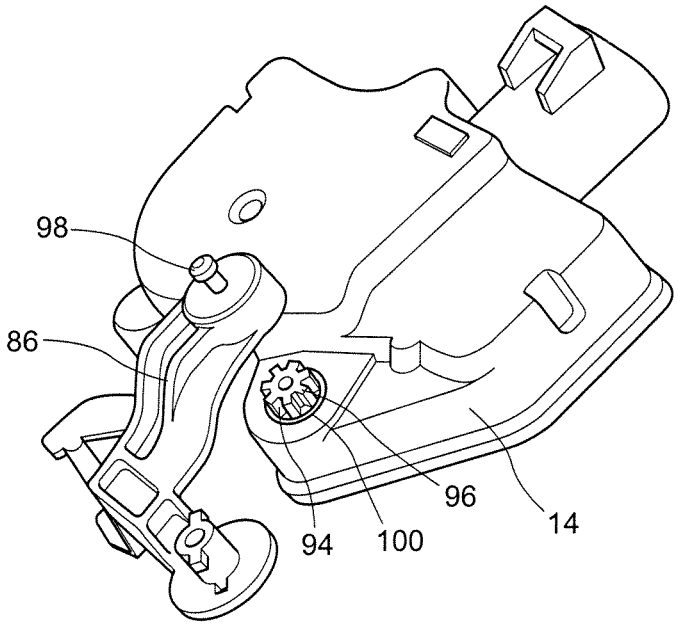
FIG. 7 is a fragmentary view of the upper housing shown in FIGS. 1-2, showing an output lever.

An output lever 86 (FIG. 1) is mounted to transfer lever 55 on the exterior of upper housing 14. Referring now to FIG. 7, a star-shaped mounting hole 92 on output lever 86 locates the output lever on a complementary star-shaped spline 94 extending out from axial post 56 on transfer lever 55. In the current embodiment, spline 94 includes seven radial teeth 96. The drafted slopes on both mounting hole 92 and teeth 96 provide for the optimum distribution of torque between transfer lever 56 and output lever 86. The complementary angles of mounting hole 92 and teeth 96 increases the contact surface area of the two levers, improving the mating component to withstand more stress. A fastener 98, such as a screw or rivet, is mounted through coaxial holes on output lever 86 and spline 94, and assists in coupling output lever 86 and transfer lever 55 together. An O-ring seal 100 prevents moisture from entering power actuator 10 through hole 58.

As can be clearly seen in FIG. 1, output lever 86 includes a lock arm 102 and a latch arm 104, the two arranged in a V-shaped configuration around mounting hole 92. Lock arm 102 includes a lock loop 106 operable to retain a manual release door lock rod (not shown). Latch arm 102 includes a mounting hole 108 operable to retain a clip for a cable connected to a side door latch (not shown). Manually actuating the door lock rod causes output lever 86 to pivot around mounting hole 92, causing the cable to actuate the side door latch. Pivoting output lever 86 between first and second positions causes transfer lever 55 and locking lever 70 to pivot as well. Locking lever 70 moves between its locked and unlocked positions, thereby ensuring that output lever 86 is moved completely into its new position. Depending tab 66 on transfer lever 55 moves from abutting one transfer lobe 64 to abutting the other transfer lobes 64. Center toggle spring 82 provides a degree of lost motion in worm gear 38 so that it does not rotate. Thus, there is no backdriving of motor 28.

Referring back to FIG. 2, an electronic or mechanical switch 110 having a "locked" and an "unlocked" state is mounted in upper housing 16. When transfer lever 55 is in its locked position, it triggers switch 110 into the locked state, and when transfer lever 55 is in its second position, it releases switch 110 into the unlocked state. State information from switch 110 is transmitted to a vehicle controller (not shown) via blades (also not shown). Electrical power for motor 26 is also provided via blades.

What is claimed is:

1. A power actuator for a door latch, the power actuator comprising:

a reversible motor mounted to a housing and operable to drive a worm;

a worm gear rotatably mounted to the housing and driven by the worm, the worm gear being rotatable between a first angular position and a second angular position upon actuation of the motor, and the worm gear including a pair of transfer lobes;

a biasing spring mounted to the housing for urging the worm gear to a neutral angular position located intermediate to the first and second angular positions when the motor is disengaged;

a transfer lever pivotally mounted to the housing by an axial post and movable between a first position and a second position, the transfer lever being coupled to the worm gear via a lost motion connection to enable the transfer lever to be moved between the first and second positions without driving the worm gear when the worm gear is in the neutral angular position;

a toggle mechanism mounted to the housing, the toggle mechanism operable to urge the transfer lever to the nearest of the first and second positions when the transfer lever is between the first and second positions;

wherein the transfer lever is rotatable by the transfer lobes of the worm gear around the axial post in a first direction and a second direction opposite the first direction, the transfer lever includes a first arm extending toward the worm gear and a second arm extending away from the first arm and the worm gear, and the second arm includes a key hole; and wherein a locking lever acts as the toggle mechanism, the locking lever is mounted to the housing by a guide post that is offset from a key post mounted in the key hole in the second arm of the transfer lever, the locking lever is rotatable around the guide post in the first direction and the second direction, and the key post on the locking lever surrounds the key hole such that rotation of the transfer lever in the first direction rotates the locking lever in the opposite second direction.

2. The power actuator of claim 1, wherein the locking lever is pivotable between a locked position and an unlocked position, wherein a toggle spring is connected at one end to the locking lever and at the other end to the transfer lever, wherein pivoting the transfer lever pivots the locking lever such that the toggle spring urges the locking lever towards the closest position of the locked position and the unlocked position and urges the transfer lever towards the closest position of the first and second position when each of the locking lever and the transfer lever has completed less than half of a respective pivot, and wherein the toggle spring urges the locking lever towards the other position of the locked position and the unlocked position and urges the transfer lever towards the other position of the first and second positions when each of the locking lever and the transfer lever has completed more than half of the respective pivot.

3. The power actuator of claim 2, further comprising an output lever, said output lever being actuated by the transfer lever.

4. The power actuator of claim 3, wherein the output lever is coupled to a spline located coaxially on the transfer lever.

5. The power actuator of claim 4, wherein the spline is star shaped and the output lever includes a complementary star-shaped mounting hole operable to locate the output lever on the spline.

6. The power actuator of claim 2, wherein pivoting the transfer lever between the first and second position triggers a sensor switch.

7. The power actuator of claim 1, wherein the transfer lobes on the worm gear are circumferentially spaced and wherein the transfer lever is independently movable between the two lobes.

8. The power actuator of claim 7, wherein rotating the worm gear from the neutral position towards one of the first and second angular positions causes one of the two lobes to engage and thereby actuate the transfer lever.

9. The power actuator according to claim 1, wherein the worm gear has a tab and the housing includes first and second shoulders for delimiting the first and second angular positions of the worm gear by abutment of the tab against the shoulders.

10. The power actuator according to claim 9, wherein the housing includes two spaced apart walls for delimiting the first and second positions of the transfer lever.

11. The power actuator according to claim 1 further including a toggle spring extending from the guide post to a depending post, the depending post extending from the second arm of the transfer lever and being located between the axial post and the key post.

12. The power actuator according to claim 11, wherein the toggle spring is connected at one end to the guide post extending from the locking lever and at the other end to the depending post extending from the transfer lever.

13. A power actuator for a door latch, the power actuator comprising:

a reversible motor mounted to a housing and operable to drive a worm;

a worm gear rotatably mounted in the housing and driven by the worm for rotation between a first angular position and a second angular position in response to actuation of the motor, the worm gear including a stop tab and a pair of transfer lobes, the stop tab delimiting the angular travel of the worm gear by abutting a first shoulder portion of the housing when the worm gear is located in the first angular position and abutting a second shoulder portion of the housing when the worm gear is located in the second angular position;

a biasing spring disposed between the housing and the worm gear and operable to urge the worm gear to a neutral angular position located intermediate to the first and second angular positions in response to disengaging the motor;

a transfer lever mounted in the housing for pivotal movement between a first position and a second position, the transfer lever being coupled to the worm gear via a lost motion connection to enable the transfer lever to be moved between the first and second positions without driving the worm gear when the worm gear is located in the neutral angular position, the transfer lever having a first arm and a second arm, the first arm configured to be selectively driven by the transfer lobes on the worm gear such that rotation of the worm gear from the neutral angular position toward the first angular position causes the transfer lever to pivot toward the first position and rotation of the worm gear from the neutral angular position toward the second angular position causes the transfer lever to pivot toward the second position; and a toggle mechanism mounted in the housing and operable to urge the transfer lever to the nearest of the first and second positions when the transfer lever is located between the first and second positions, the toggle mechanism including a locking lever having a guide post and a key post that is offset from the guide post, the guide post being retained in a guide slot formed in the housing and the key post being pivotably mounted in a key hole formed in the second arm of the transfer lever such that pivotal movement of the transfer lever between the first and second positions causes corresponding pivotal movement of the locking lever between a first position and a second position.

14. The power actuator according to claim 13 wherein pivotal movement of the transfer lever is delimited by a first wall portion and a second wall portion of the housing, wherein the transfer lever abuts the first wall portion of the housing when located in the first position, and wherein the transfer lever abuts the second wall portion of the housing when located in the second position.

15. The power actuator according to claim 13 further including a toggle spring operably connected between the transfer lever and the locking lever.

16. The power actuator according to claim 15 wherein the toggle spring is connected between the guide post of the locking lever and a depending post extending from the second arm of the transfer lever.

17. The power actuator according to claim 16 wherein the transfer lever is pivotably mounted in the housing via an axial post, and wherein the depending post is located between the axial post and the key post.

18. The power actuator according to claim 15 wherein the toggle spring is connected at one end to the locking lever and at the other end to the second arm of the transfer lever, and wherein pivotal movement of the transfer lever between the first and second positions causes corresponding pivotal movement of the locking lever between the first and second positions, wherein the toggle spring urges the locking lever towards the closest position of the first and second positions and urges the transfer lever towards the closest position of the first and second positions when each of the locking lever and the transfer lever have completed less than half of a respective pivotal movement, and wherein the toggle spring urges the locking lever towards the other position of the first and second positions and urges the transfer lever towards the other position of the first and second positions when each of the locking lever and the transfer lever have completed more than half of the respective pivotal movement.

19. The power actuator according to claim 13 wherein the pair of transfer lobes on the worm gear are circumferentially spaced, and wherein the transfer lever is independently moveable between the pair of transfer lobes.

20. The power actuator according to claim 19 wherein rotation of the worm gear from the neutral angular position towards the first angular position causes a first one of the pair of transfer lobes to engage the first arm of the transfer lever and forcibly pivot the transfer lever toward the first position, and wherein rotation of the worm gear from the neutral angular position towards the second angular position causes a second one of the pair of transfer lobes to engage the first arm of the transfer lever and forcibly pivot the transfer lever toward the second position.

21. The power actuator according to claim 13 further comprising an output lever fixed for pivotal movement with the transfer lever, wherein the output lever includes a lock arm and a latch arm, wherein the lock arm is adapted to be operably connected to a moveable door handle, and wherein the latch arm is adapted to be operably connected to a moveable latch component of the door latch such that movement of the output lever in response to movement of the door handle causes corresponding movement of the latch component to release the door latch.

22. A power actuator operable for locking and releasing a door latch associated with a door of a motor vehicle, the power actuator comprising:

a housing;

a reversible electric motor mounted to the housing and operable to rotatably drive a worm;

a worm gear rotatably mounted to the housing and driven by the worm through a range of angular movement defined by a locking position and an unlocking position in response to actuation of the motor, the worm gear including a stop tab, a depending tab, and first and second circumferentially-spaced transfer lobes, the stop tab configured to delimit the range of angular movement by engaging a first shoulder portion of the housing when the worm gear is located in the locked position and engaging a second shoulder portion of the housing when the worm gear is located in the unlocked position;

a centering spring disposed between the depending tab on the worm gear and the housing and operable to normally urge the worm gear to a neutral position located midway between the locking and unlocking positions in response to disengaging the motor;

a transfer lever mounted via an axial post to the housing for pivotal movement between a locked position and an unlocked position, the transfer lever being coupled to the worm gear via a lost motion connection to enable the transfer lever to move between the locked and unlocked positions without driving the worm gear while the worm gear is located in the neutral position, the transfer lever configured to include a first arm segment extending from the axial post toward the worm gear and a second arm segment extending from the axial post away from the first arm segment and the worm gear, wherein the first arm segment is configured to be selectively driven by the first transfer lobe in response to rotation of the worm gear from its neutral position to its locking position so as to forcibly pivot the transfer lever toward its locked position, and wherein the first arm segment is configured to be selectively driven by the second transfer lobe in response to rotation of the worm gear from its neutral position to its unlocking position so as to forcibly pivot the transfer lever toward its unlocked position;

a locking lever having a guide post slidingly and pivotably retained in the guide slot and a key post disposed in a key hole formed in the second arm segment of the transfer lever; and a toggle spring interconnecting the locking lever and the second arm segment of the transfer lever;

wherein pivotal movement of the transfer lever between its locked position and its unlocked position causes corresponding pivotal movement of the locking lever between a locked position and an unlocked position, wherein the toggle spring urges the transfer lever to move toward the nearest one of its locked and unlocked positions when the transfer lever has completed less than half of a pivotal movement from one of its positions to the other one of its positions, and wherein the toggle spring urges the transfer lever toward the other one of its locked and unlocked positions when the transfer lever has completed more than half of a pivotal movement from one of its positions toward the other one of its positions.

23. The power actuator according to claim 22 wherein the toggle spring also urges corresponding pivotal movement of the locking lever such that the locking lever is urged toward the nearest one of its locked and unlocked positions when the locking lever has completed less than a half of a pivotal movement from one of its positions to the other one of its positions, and wherein the toggle spring urges the locking lever toward the other of its locked and unlocked positions when the locking lever has completed more than half of a pivotal movement from one of its positions toward the other one of its positions.

24. The power actuator according to claim 22 wherein pivotal movement of the transfer lever is delimited by first and second laterally-spaced wall portions of the housing, wherein the transfer lever abuts the first wall portion of the housing when located in the locked position, and wherein the transfer lever abuts the second wall portion of the housing when located in the unlocked position.

25. The power actuator according to claim 22 wherein the toggle spring is connected between the guide post extending from the locking lever and a depending post extending from the second arm segment of the transfer lever.

26. The power actuator according to claim 22 wherein the transfer lever is independently moveable between the circumferentially-spaced first and second transfer lobes in response to movement of an output member fixed for pivotal movement with the transfer lever.

27. The power actuator according to claim 26 wherein the output member includes a first arm operably connected to a handle on the door, and a second arm operably connected to a moveable latch component of the door latch.

* * * * *